US005173981A

United States Patent [19]

Hasselkvist

[11] Patent Number: 5,173,981

[45] Date of Patent: Dec. 29, 1992

[54] BRIDGE CONSTRUCTION KIT AND BRIDGE ELEMENTS INCLUDED THEREIN

[75] Inventor: Rolf Hasselkvist, Hasslö, Sweden

[73] Assignee: Karlskronavarvet AB, Karlskrona, Sweden

[21] Appl. No.: 680,519

[22] Filed: Apr. 4, 1991

[30] Foreign Application Priority Data

Apr. 18, 1990 [SE] Sweden ..... 90 01382

[51] Int. Cl.[5] ..... E01D 15/12

[52] U.S. Cl. ..... 14/2.4; 14/77.1

[58] Field of Search ..... 14/2.4, 2.5, 77.1, 13, 14/14

[56] References Cited

U.S. PATENT DOCUMENTS

| | | | |
|---|---|---|---|
| 4,075,727 | 2/1978 | Sedlecek et al. | 14/2.4 |
| 4,520,523 | 6/1985 | Fitzgerald-Smith et al. | 14/14 |
| 5,042,101 | 8/1991 | Huether | 14/2.4 |

FOREIGN PATENT DOCUMENTS

| | | | |
|---|---|---|---|
| 588492 | 9/1989 | Australia . | |
| 2757647 | 6/1979 | Fed. Rep. of Germany | 14/2.4 |
| 2038391 | 7/1980 | United Kingdom . | |

*Primary Examiner*—William P. Neuder

*Attorney, Agent, or Firm*—Young & Thompson

[57] ABSTRACT

A construction kit for a multispan military or army bridge, comprising a plurality of bridge elements (1) which carry track lanes (10, 11), and coupling devices (15, 16) for coupling a plurality of bridge elements together to form a row of such elements, and further comprising a plurality of ramp sections (2, 3) which form drive-on and drive-off ramps on the bridge construction. The construction kit is characterized in that it comprises a crane carriage (4) for lifting a bridge element into a position in which it can be coupled to another bridge element; locking devices for coaction with the locking devices (15, 16) when coupling to bridge elements together; and support-leg pairs (120, 121) which function to support the mutually coupled bridge elements. The whole of the construction kit can be accommodated on conventional trucks or lorries (8). The invention also relates to the actual bridge element, crane carriage, locking devices and support-leg pairs themselves.

22 Claims, 11 Drawing Sheets

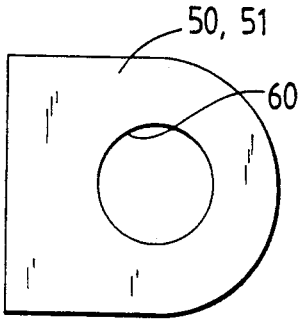
Fig. 8
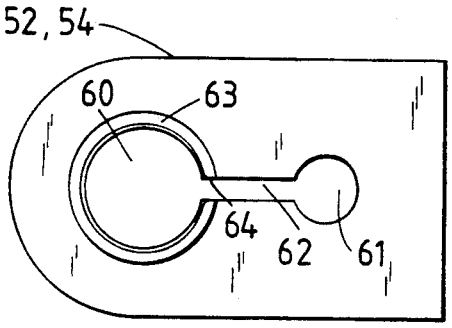
Fig. 9
Fig. 10
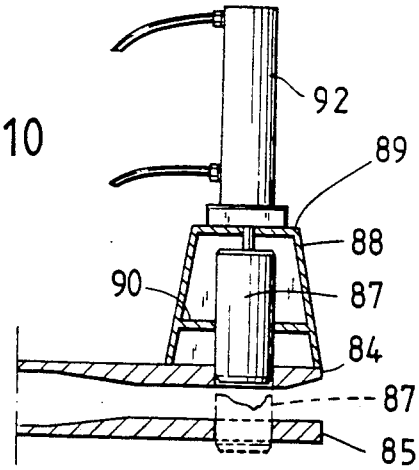
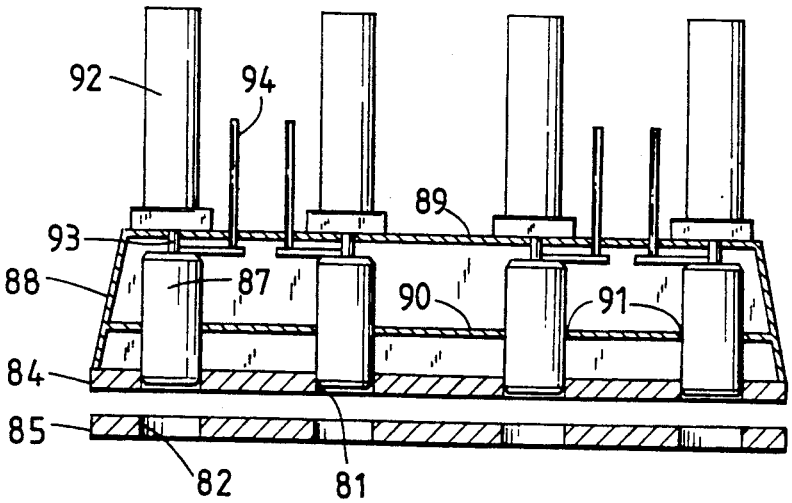
Fig. 11

BRIDGE CONSTRUCTION KIT AND BRIDGE ELEMENTS INCLUDED THEREIN

The present invention relates to a bridge construction kit and then preferably to a kit intended for the construction of a multispan military or army bridge.

Many different requirements can be placed on a military bridge. For instance, it must be possible to construct and lay the bridge quickly under field conditions with the use of the minimum number of workmen, and it must also be possible to transport the bridge construction kit easily to the site at which the bridge is to be layed.

Among other things, these requirements have resulted in the construction of military bridges from readily transportable lightweight aluminium-beam frameworks which can be carried easily by personnel. Such aluminium frameworks, however, tend to become particularly complicated, due to the requirements placed on the load bearing capacity of the finished bridge. Consequently, a military or army bridge constructed from aluminium in this way is expensive to produce. German Patent Specifications 2 540 267 and 2 812 531 teach collapsible beam structures for use in the construction of military bridges. Each beam comprises plates which are mutually joined together by means of dovetail couplings formed in the plates. Two such beams are placed adjacent one another and connected together with the aid of cross-struts, to form a bridge element. A plurality of these bridge elements are joined together in a row, with the aid of bolts which extend between blocks mounted on the side-walls of each beam.

The drawback with these known constructions is that it takes a very long time and the use of a large number of men to assemble the beams and then to join the beams together to form a bridge element and then to couple the bridge elements together in a row to form a bridge.

The British Patent Specification 2 038 391 illustrates an example of a military bridge which consists of one single span and which is carried on a special-purpose vehicle. The drawback with the use of such special-purpose vehicles for transporting military bridges is that the vehicle can only be used for its intended purpose, i.e. to transport military bridges.

One object of the present invention is to provide a bridge construction kit which can be transported on conventional trucks or lorries.

Another object of the invention is to provide in said bridge construction kit a bridge element of framework construction, where each bridge element is made of steel and has a high load bearing capacity such as to enable several bridge elements to be joined together in a row and therewith form a cantilever construction.

Still another object of the invention is to provide a bridge construction kit which includes a specially constructed shuttle which can be moved reciprocatingly beneath the bridge under construction, for the purpose of collecting a further bridge element and moving said further element to the outer extremity of the bridge.

Yet another object of the invention is to provide a bridge construction kit in which the shuttle, or alternatively a trolley, is provided with a conventional hydraulic crane operative to lift a transported bridge element into a position in which it can be coupled to the outermost end of said bridge.

Yet another object of the invention is to provide a bridge construction kit with which the bridge elements are connected together in a row with the aid of a locking rod or bar which extends transversely across the bridge.

Another object of the present invention is to provide a bridge construction kit which includes a plurality of support-leg pairs for supporting the bridge at regular intervals along its length.

These and other objects are achieved with a bridge construction kit of the kind defined in the preamble of the following claim 1. Other characteristic features of the invention are set forth in the depending claims.

The invention will now be described in more detail with reference to the accompanying drawings, in which FIG. 1 is a perspective view of an inventive construction kit;

FIG. 8 is a side view, in larger scale, of a first type of coupling lug;

FIG. 9 is a side view taken on the line IX—IX in FIG. 7 and illustrates a second type of coupling lug, on a larger scale;

FIG. 10 is a side view, partially in section, of a second type of coupling device for coupling two bridge elements together;

FIG. 11 is a front view, partly in section, of the coupling device illustrated in FIG. 10;

Figure 1:
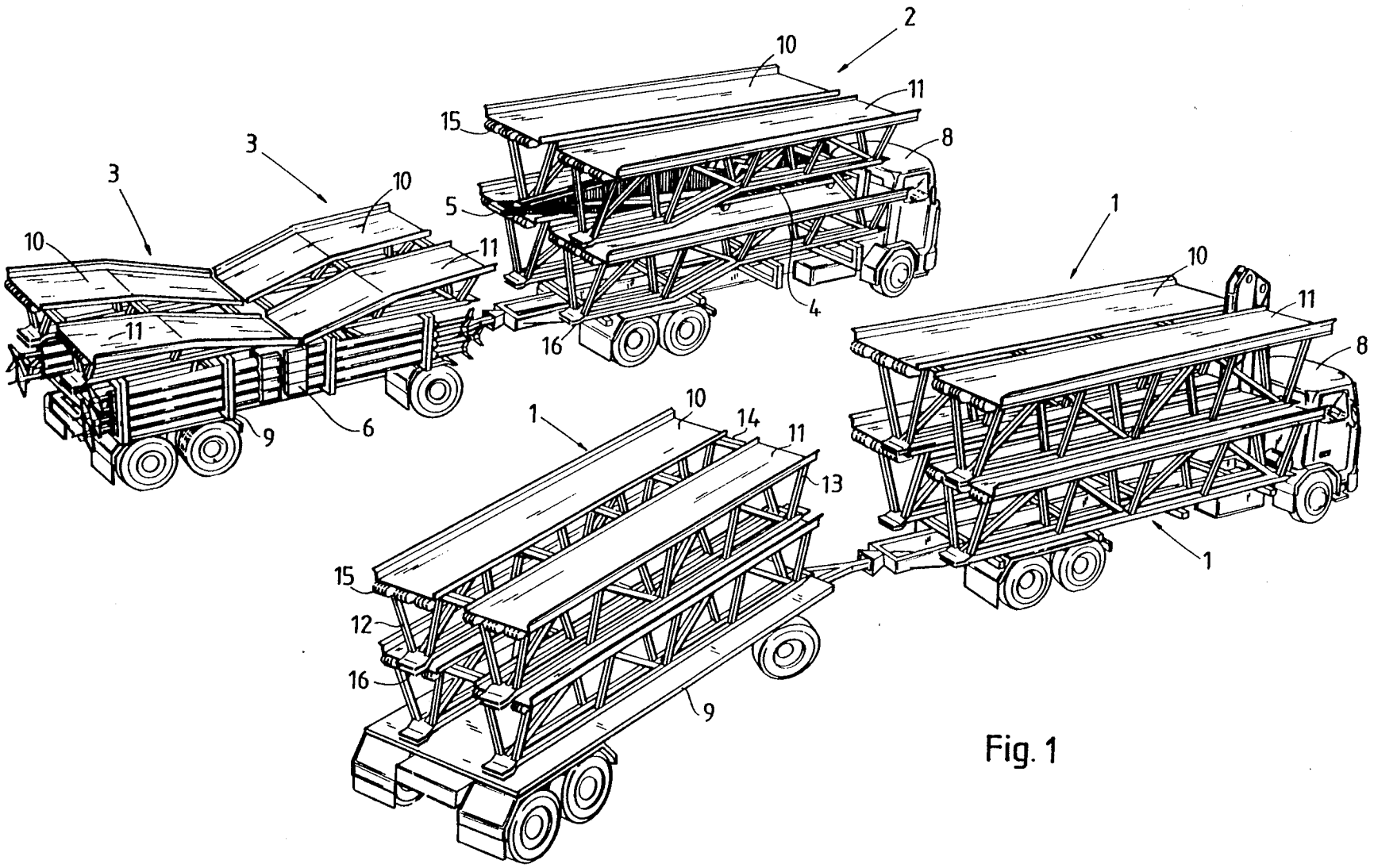
Figure 12:
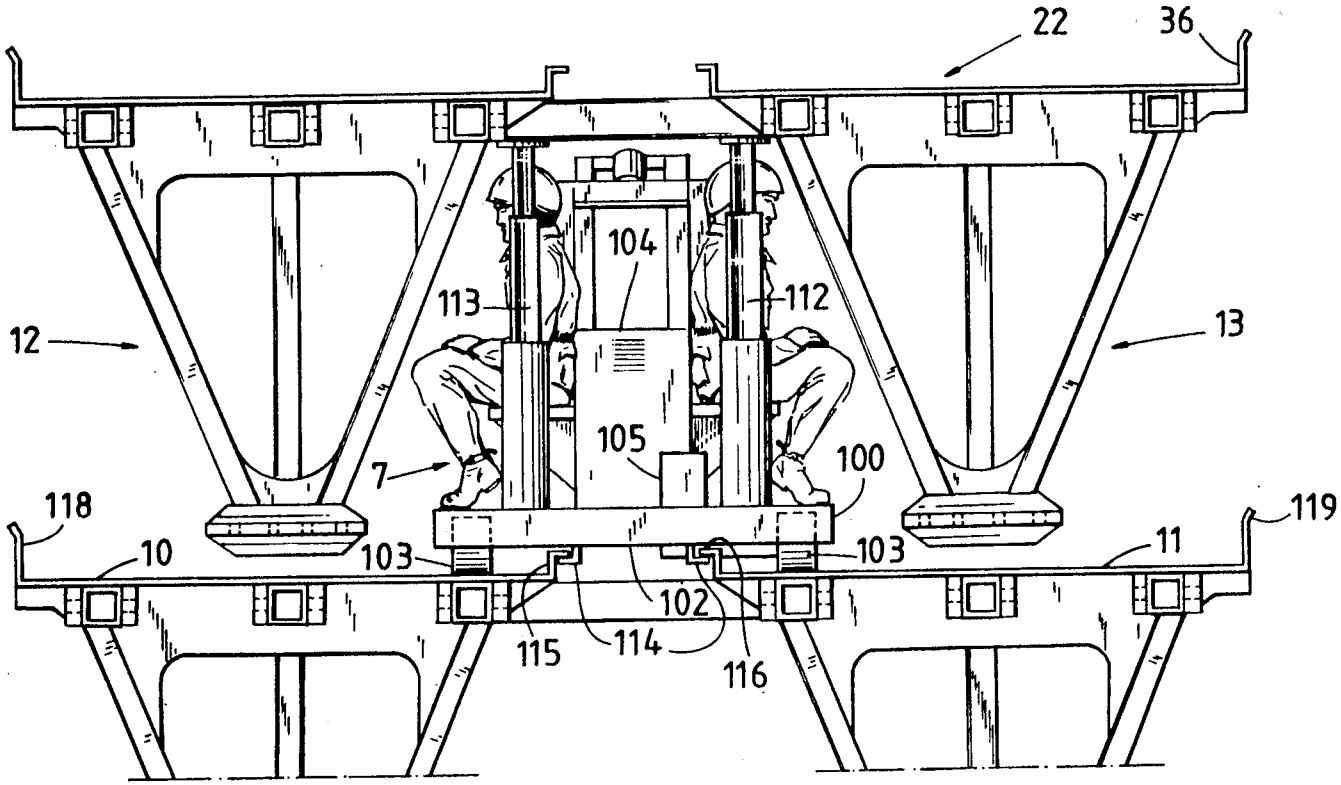
FIG. 12 is a schematic top front view of a shuttle included in the inventive construction kit.

FIG. 1 illustrates an inventive bridge construction kit. The construction kit includes a number of bridge elements 1, two ramp sections 2 of a first kind, and two ramp sections 3 of a second kind. The kit also includes a crane carriage 4 having a hydraulic lifting arm or jib 5. The kit also includes pairs of support legs 6 and, when very long bridges are to be constructed, a shuttle 7 which is shown in FIG. 12. The various components of the construction kit are transported on conventional trucks 8 provided with trailers 9. Suitably, at least one truck is equipped with a hydraulic lifting crane, as illustrated with the vehicle shown at the bottom of FIG. 1.

Figure 2:
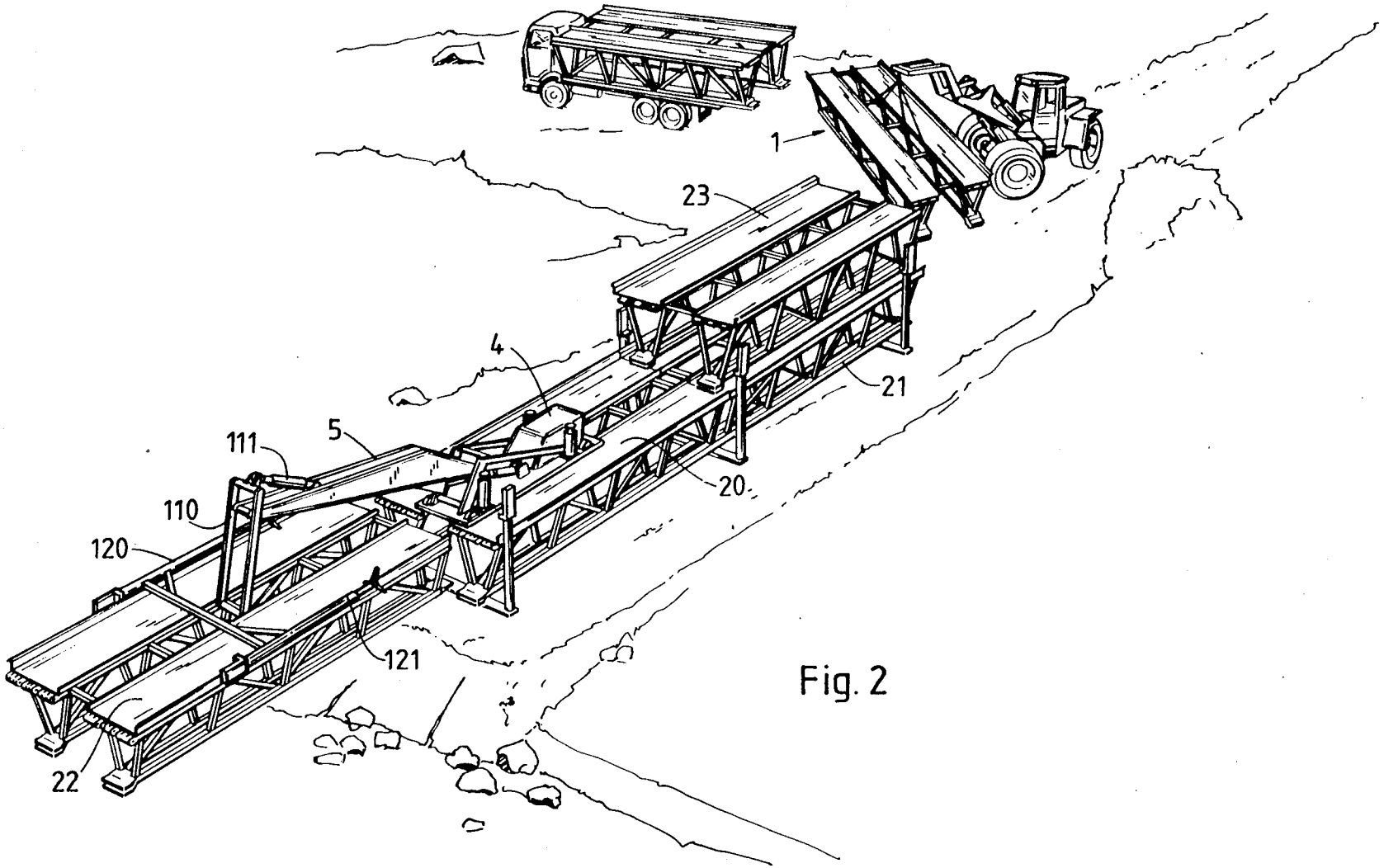
FIG. 2 is a perspective view of a bridge under construction.

The components can be lifted from the trucks by means of a conventional tractor fitted with lifting forks, as illustrated in FIG. 2.

It will be seen from FIG. 1 that each bridge element 1 and each ramp section 2, 3 includes two mutually parallel track lanes 10, 11. The bridge elements 1 and the ramp sections 2, 3 are framework constructions and include a first section 12 which supports the one track lane 10, a second section 13 which supports the other track lane 11, and a third section 14 which connects the first and the second sections together.

The bridge elements 1 and the ramp sections 2, 3 are provided with coupling devices which enable the bridge elements to be connected one to the other and also to the ramp sections. These coupling devices also enable a ramp section of the first kind to be connected to a ramp section of the second kind. The coupling devices are shown schematically at reference numerals 15 and 16 in FIG. 1. The coupling devices are provided at each end of respective bridge elements 1 and ramp sections 2, whereas coupling devices are only provided at one end of respective ramp sections 3.

FIG. 2 illustrates the procedural steps taken when laying a multispan bridge. In the illustrated case, several bridge elements 1 have earlier been connected mutually to form a long line. The outermost bridge element is referenced 20 and the innermost 21. The crane carriage 4 has lifted a bridge element 22 over the track lanes 10, 11 and is in the process of transporting the raised bridge element 22 to the outermost bridge element 20. Meanwhile, the tractor or truck crane has lifted a further bridge element 23 onto the innermost bridge element 21. When the crane carriage 4 has reached the bridge element 20, it lowers the bridge element 22 onto this outermost bridge element and reverses slightly, so that the lifting arm 5 is freed and able to raise the bridge element 22 slightly. The crane carriage 4 is then driven forwards somewhat and the bridge element 22 is lowered so that its coupling devices can be connected to corresponding coupling devices on the bridge element 20. The coupling devices are then locked with the bridge element 22 supported in cantilever fashion. A plurality of bridge elements can be connected together in a cantilever fashion in this way, before needing to support the bridge with a leg support pair 6. The spacing between two such support leg pairs 6 is called a span. The length of a span depends, among other things, on the load acting on the bridge, and can vary.

A bridge element 1 will now be described in more detail with reference to the accompanying FIG. 3-5. The first section 12 is identical to the second section 13 and consequently only the first section 12 will be described in detail. The first section comprises a pair of mutually parallel longitudinally extending bottom beams 30, 31 which are mutually spaced at a short distance apart in a first plane. The mutually facing inner surfaces of the bottom beams are welded firmly to the bottom end of struts or braces 32 which extend vertically in the cross-section of the bridge element and, in the longitudinal section of said element, extend diagonally between the bottom beams and a central beam 33 located thereabove, this central beam being described in more detail herebelow. The central beam is thus supported by the struts 32.

Located in a plane above the first plane is a triplet of top beams, comprising two outer beams 34, 35 and the aforesaid central beam 33. The top beams 33, 34, 35 of said beam triplet extend parallel to one another and the spacing between said beams is greater than the spacing between the mutually parallel bottom beams 30, 31. Mounted on the upper surface of respective top beams 33, 34, 35 is a track lane 10, which includes a bottom plate and an upstanding side verge 36. The outer beams 34, 35 are supported by pairs of outer struts 37, 38. The outer strut 37 extends from the bottom beam 30 to the outer beam 34, whereas the outer strut 38 extends from the bottom beam 31 to the outer beam 35. Seen in the cross-section of the bridge element and in those directions shown in FIG. 7, the outer struts 37, 38 form a V-shape, and seen in the longitudinal section of the bridge element, the outer struts 37, 38 are vertically upstanding as illustrated in FIG. 3.

The third section 14 is located between the first and the second sections 12, 13 and includes a plurality of cross-beams 39 which are arranged at regular intervals along the length of the bridge element. These cross-beams 39 extend transversely to the longitudinal extension of the bridge, between the adjacent outer beams 35 of the first and the second sections 12, 13, and are welded thereto and also to bracing plates 40.

Figure 4:
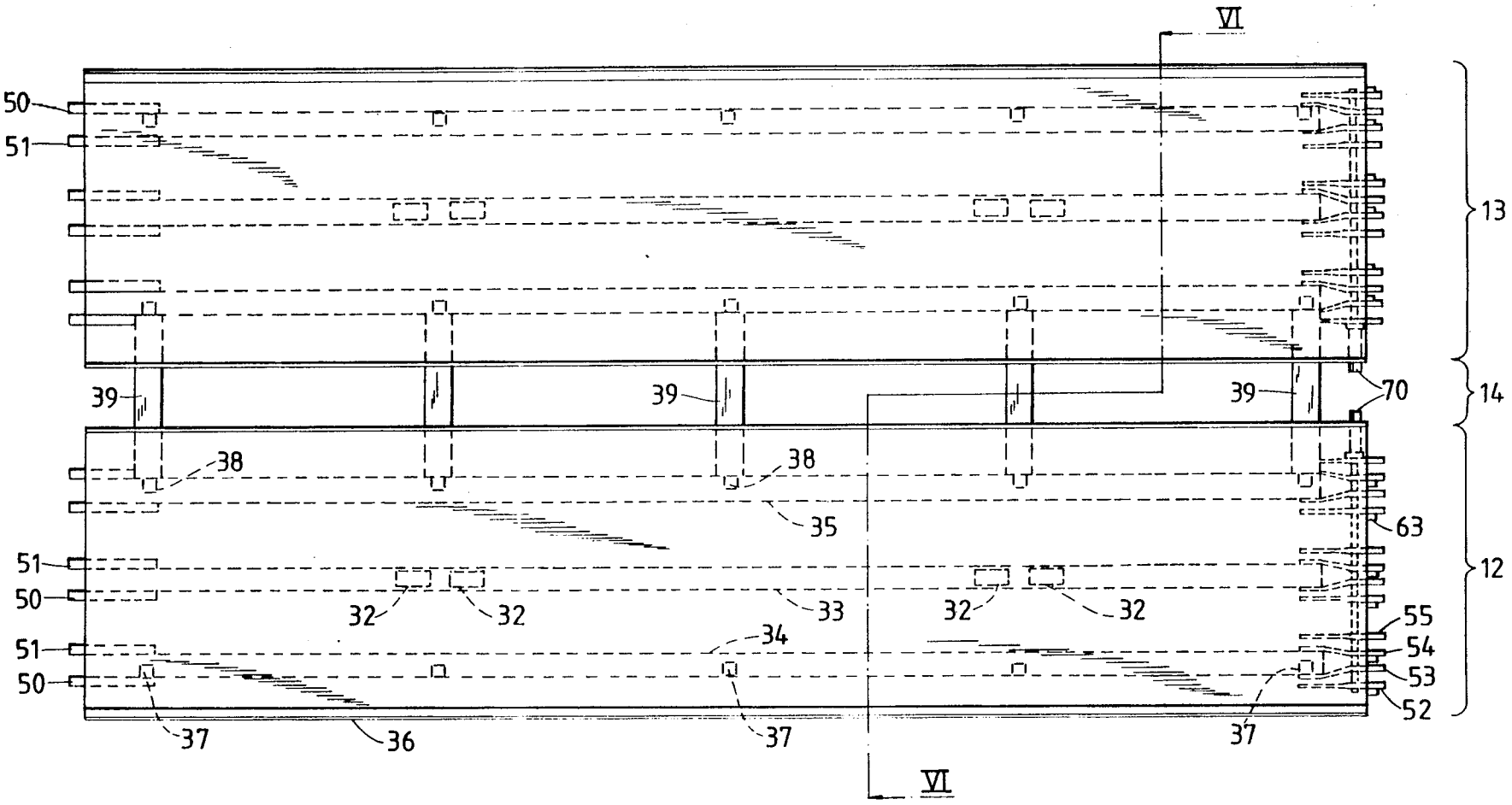
FIG. 4 is a top view of the bridge element shown in FIG. 3 and is taken on the line IV—IV in said Figure.
Figure 5:
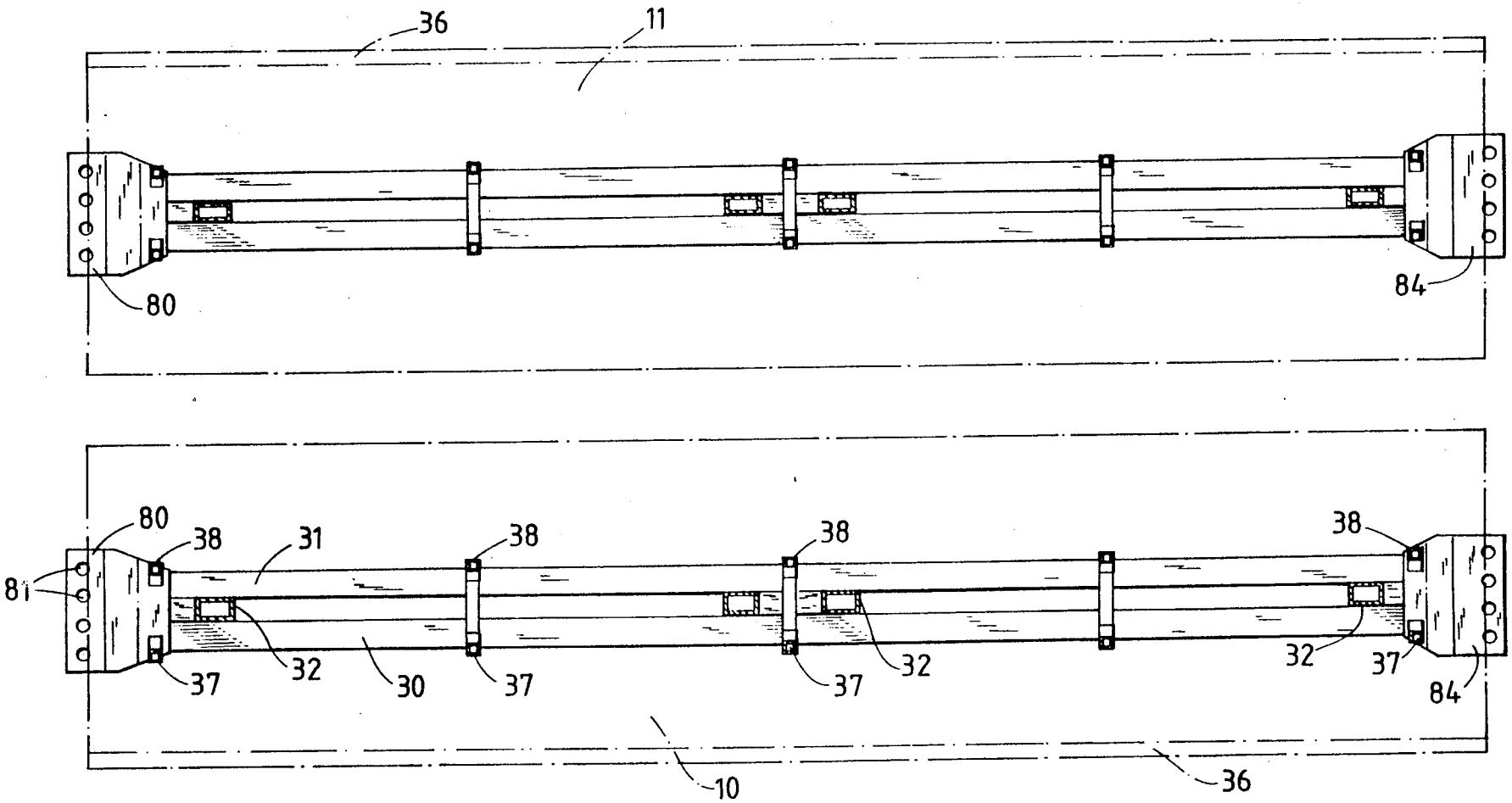
FIG. 5 is a longitudinal sectional view taken on the line V—V in FIG. 3.

Seen in top view and in the directions shown in FIG. 4, the outer struts 37, 38 are in line with a cross-beam 39. A brace plate 40 extends between the upper part of the outer strut 38 and the cross-beam 39.

Figure 6:
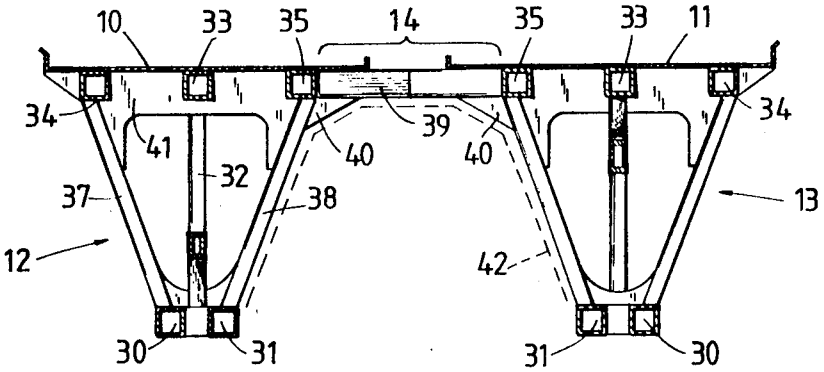
FIG. 6 is a cross-sectional view of the bridge element shown in FIG. 5 taken on the line VI—VI in said Figure.

As will be seen from FIGS. 6 and 4, additional brace plates 41 are disposed between the inner surface of the outer struts 37 and 38, in the upper part thereof. The upper parts of respective brace plates 41 are welded to the top beams 33, 34, 35, in the manner illustrated in FIG. 6.

The whole of the framework construction is welded and comprises steel plate beams.

According to one preferred embodiment of the invention, each bridge element has a length of about 8 m, a width of 4 m and a vertical extension or height of about 1.5 m. Each track lane has a width of about 1.8 m.

As will be seen from FIG. 6, and also to some extent from FIG. 1, there is formed between the first, second and third sections a longitudinally extending space, indicated by the broken line 42 in FIG. 6, which in cross-section has the shape of an inverse V with a truncated apex. When seen in the longitudinal direction of the bridge element, this space is free of all obstacles and will enable the crane carriage 4 or the shuttle 7 to be driven in beneath the bridge element, in the manner illustrated in FIG. 12, in order to lift and transport said element.

In the case of the bridge element illustrated in FIGS. 3-6, the top beams 33, 34, 35 lie in a plane which is parallel to the plane in which the bottom beams 30, 31 lie. In the ramp section 3 of said second kind, the plane in which the top beams lie is inclined relative to the plane of the bottom beams. In the ramp section 2 of said first kind, the top beams lie in a plane which is common to said top beams, whereas the bottom beams 30, 31 are angled in the illustrated fashion, so as to lie in two mutually different and mutually parallel planes, which are also parallel with the plane of the top beams. It will be seen that the ramp sections 2 and 3 will function as drive-on and drive-off ramps at both extremities of the bridge.

Two bridge elements are connected together by means of coupling devices comprising a first coupling type 15 and a second coupling type 16. The coupling devices of the first type 15 are provided at respective end surfaces of the top beams 33, 34, 35, whereas the coupling devices of the second type 16 are arranged at the end surfaces of the bottom beams 30, 31. The first type of coupling device 15 is a male and female coupling, as is also the second type of coupling device 16. The female part of the coupling device 15, 16 is mounted on one and the same end of the bridge element, whereas the male part of the coupling devices 15, 16 is mounted on the opposite end of said bridge element. Thus, the bridge element will have a male coupling side and a female coupling side as illustrated in FIGS. 3 and 4 respectively.

The first type of coupling device 15 includes an upstanding coupling lug, whereas the second type of coupling device 16 includes a coupling tongue. The coupling devices on the male side of a bridge element are intended to fit into the coupling devices on the female side of another bridge element.

Figure 3:
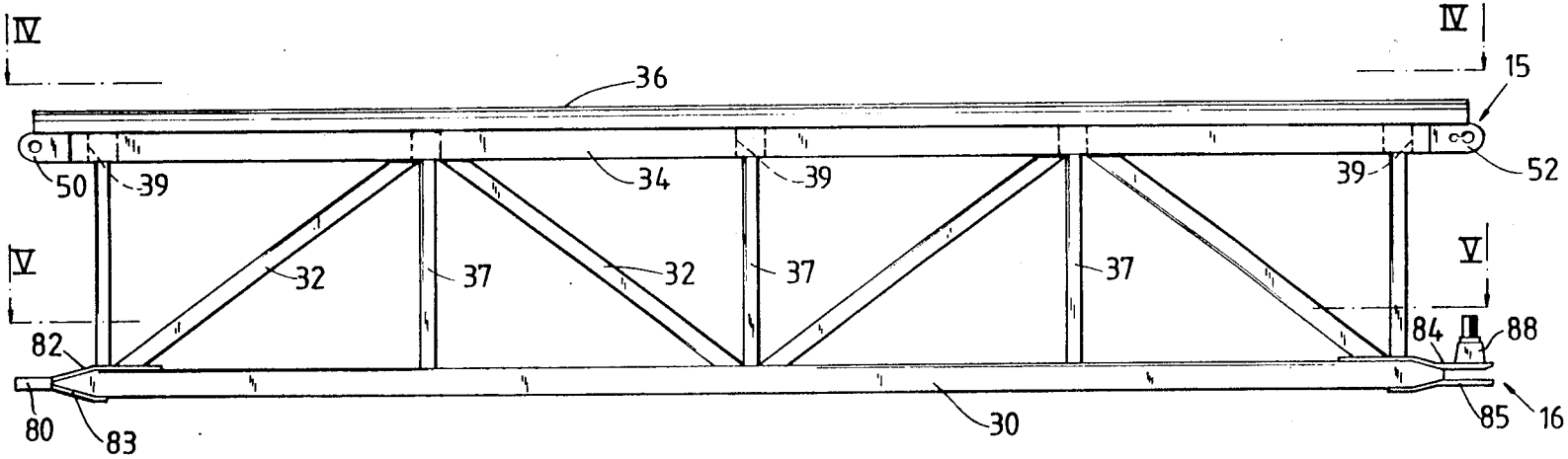
FIG. 3 is a side view of an inventive bridge element.

As will be seen from FIGS. 3, 4 and 8, each first type of coupling device on the male side of the bridge element has a coupling lug 50 which is on a level with one side surface of the outer beam 34 and another coupling lug 51 which is on a level with the opposing side surface of the same outer beam. Correspondingly, pairs of such lugs 50, 51 are mounted on the remaining central beam 33 and outer beam 35 of the beam triplet. A number of female coupling lugs 52, 53, 54, 55 are mounted on the female side of the bridge element. The coupling lugs 52, 53 form pairs of lugs which are intended to receive a male type coupling lug 50 therebetween, whereas the coupling lugs 54, 55 form another pair of lugs which are intended to receive the coupling lug 51 therebetween. Correspondingly, each of the remaining top beams of the beam triplet is provided with quartets of female-type coupling lugs 52–55. The coupling lugs 52, 53 are displaced in relation to the side surface of the outer beam 34, whereas the lugs 54, 55 are displaced relative to the opposite side surface of the same outer beam 34.

All of the lugs 50–55 comprise metal plate pieces which are welded to the side surfaces of the top beams. The male-type coupling lugs 50, 51 have a through-passing opening 60 formed therein, as illustrated in FIG. 8, and the female-type coupling lugs have a corresponding through-passing opening 60 and, in addition thereto, a through-passing opening 61 and an elongated third opening 62 passing through the plate and connecting the opening 60 and 61 together. The lugs 52, 54 on the female side are also provided with a guide annulus which surrounds the opening 60 and has an axially extending slot 64.

Figure 7:
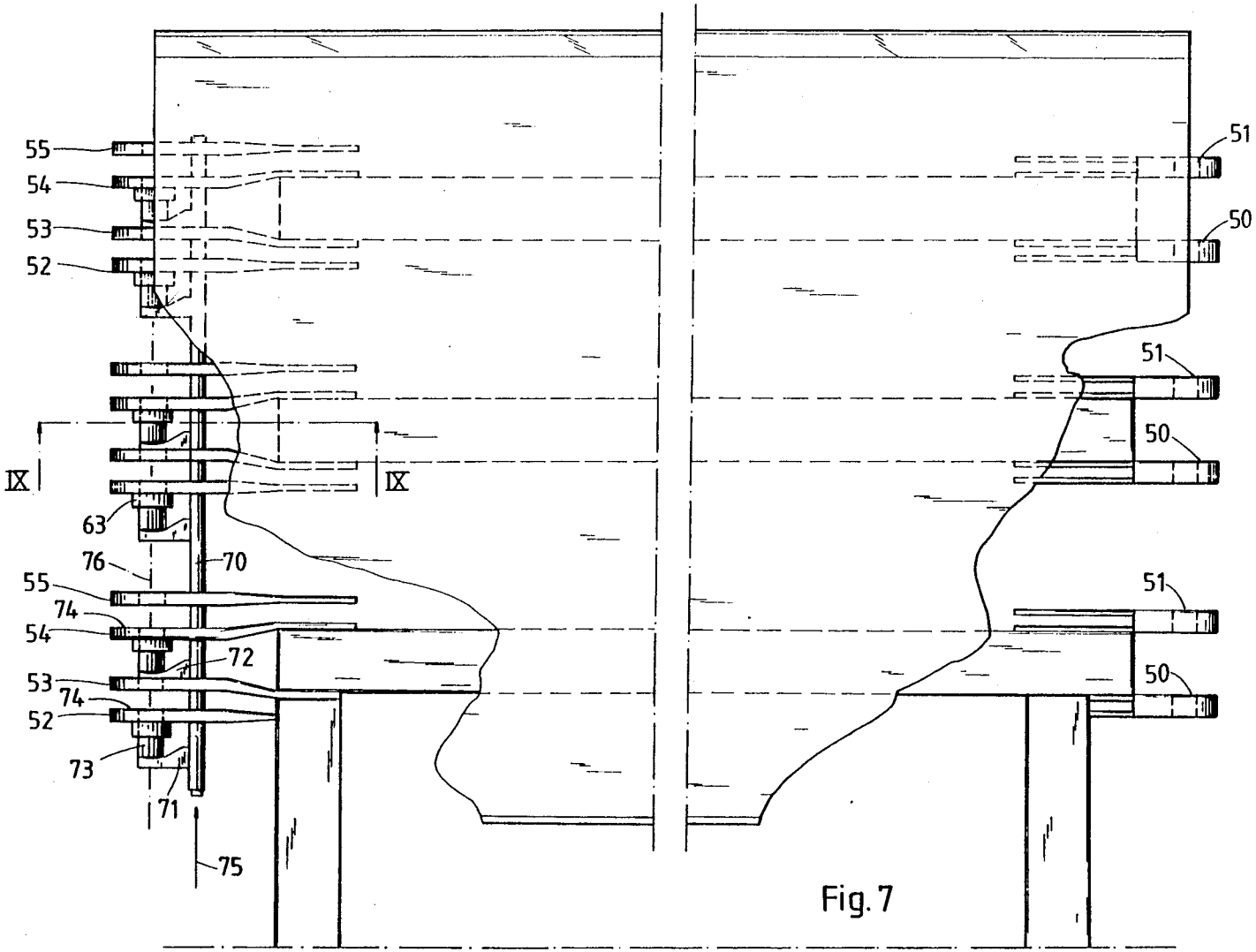
FIG. 7 is a sectional view similar to the view of FIG. 4, and shows a first type of coupling device for coupling two bridge elements together.

As a preparatory step before connecting two bridge elements together, a locking rod 70, shown in FIG. 7, is inserted through the opening 61 on the female-type coupling lugs. The locking rod has welded thereto a number of dogging elements 71, 72 which project radially from said rod at mutually the same angular position thereon, in other words the dogging elements 71, 72 are in line with one another. Mounted on the end of each dogging element 71, 72 is a locking pin or stud 73. The arrangement is such that the locking pin 73 projects into the guide annulus 63 and through the thickness of the coupling lug 52 and 54 respectively. Thus, the end surface of the locking pin 73 will lie on a level with an end wall surface 74 of the lug 52. The end surface of the locking pin 73 on the dogging element 72 is also on a level with a corresponding end wall surface 74 of the lug 54, at the same time as the spine part of the dogging element 72 lies within the opening 60, 61 and 62 on the lug 53. The dogging element 71 comprise metal-plate pieces whose thicknesses correspond to the width of the elongated opening 62.

In preparation to coupling to bridge elements together, the locking rod 70 is inserted through the opening 61 in the female-type coupling lugs, wherewith the dogging elements 71, 72 and the locking pin 73 pass through the opening 62 and 60 respectively. The position of the locking rod 70 is then adjusted to the position shown in FIG. 7. When the male coupling lugs 50, 51 of another bridge element have been inserted between the female coupling lugs and have been adjusted so that the openings 60 on the lugs 50, 51 register with the opening 60 on the lugs 52–55, the bridge elements can be locked together. This is effected by pushing the rod 70 in the direction of the arrow 75 in FIG. 7, wherewith the locking pins pass completely through the opening 60 in the lugs 50, 51 and also project slightly into the wall of the lugs 53 and 55 respectively. This results in stable connection of the bridge elements.

When two bridge elements have been mutually connected in this way, the outermost bridge element can be swung around the centre line 76 of the locking pins 73 to a position in which the second kind of coupling device 16 on the male side of the outermost bridge element are swung into the second type of coupling devices 16 on the female side of the stationary bridge element.

The coupling devices 16 of said second kind have a conical configuration reminiscent of a conventional paper hole punch. The male side (FIG. 3) consists of a coupling tongue 80 in which a number of through-passing openings 81 are formed, in the illustrated embodiment four openings 81 (FIG. 5). The coupling tongue 80 is welded to the bottom beams 30, 31 with the aid of mounting plates 82, 83 welded respectively to the top and bottom surfaces of the bottom beams.

Similarly, two coupling tongues 84, 85 (FIG. 3) are mounted one above the other on the female side of the bridge element. These tongues 84, 85 also have a row of openings 82 formed therein (FIG. 5), in the illustrated case four such openings, which are located vertically one above the other in the two coupling tongues 84, 85. These tongues 84, 85 also consist of metal-plate elements which are welded respectively to the top and bottom sides of the bottom beams 30, 31. The vertical extension of the space between the tongues 84, 85 corresponds to the vertical extension of the tongue 80. The upper tongue 84 has mounted thereon a number of locking pins or studs 87 (FIGS. 10 and 11) and a holder 88 for holding the locking pins in a vertical position. The holder 88 in the form of a housing which comprises a top wall 89, end walls, side walls and an elongated guide plate 90 provided with guide openings 91 disposed vertically above the openings 81.

Each locking pin 87 coacts with an activating means 92 mounted on the top wall 89. The activating means 92 is preferably a hydraulic piston-cylinder unit, the piston rod 93 of which is fastened to the locking pin 87. The locking pins 87 can be moved between an upper, open position, shown in full lines in FIG. 11, and a lower, locked position in which the pins extend through the openings 81 on the male coupling tongue 80 and also through the openings 82 on the lower coupling tongue 85.

Provided in the region where the locking pin 87 is connected to the piston rod 93 is a rod 94 which passes through the top wall 89 and which accompanies movement of the locking pin. This rod serves as a visual indication that the pin has truly taken its lower locked position. One such rod 94 is provided for each locking pin 87.

FIG. 12 shows a cross-sectional view of a carriage 100 having an elongated chassis 102 and functioning as a shuttle 7. A number of wheels 103 are mounted on respective sides of the chassis 102, these wheels being intended to roll on the track lanes 10 and 11. The chassis carries a drive motor 104, preferably an internal combustion engine, which drives the carriage wheels 103 via hydraulic motors 105. As will be seen from FIG. 12, the cross-sectional profile of the carriage is so low as to enable the carriage to be driven in beneath the elongated space 42 formed between the first and the second sections 12, 13 of the bridge element. The hitherto described carriage can now be provided with auxiliary devices, the nature of which depends on whether the carriage shall be used as a shuttle or a crane carriage.

When the carriage is to be used as a crane carriage, the carriage is fitted with the hydraulic lifting arm 5 (shown in FIGS. 1 and 2) at one end of the carriage 100. The lifting arm 5 has two ends, of which one is pivotally attached to the carriage or its chassis, so that the arm can be swung in a vertical plane. The other end of the lifting arm is provided with a lifting device 110 (FIG. 2) having the form of a frame which is pivotally mounted at said other end of the lifting arm. A piston-cylinder device 111 enables the lifting device 110 to be swung relative to the lifting arm 5. In order to prevent the crane carriage, from toppling when lifting a bridge element, tipping-counteracting means in the form of two L-shaped bars 114 (FIG. 12) are mounted on the underside of the carriage, said bars projecting downwardly and facing away from each other. The lower section of each L-shaped bar will, in this way, extend beneath horizontally extending plates 115, 116 which form inner track-lane verges and project slightly beyond the actual track lane on the bridge element. Each track lane also has an outer track lane verge 118 and 119 respectively. It will be understood that the bottom section of each L-shaped bar may be provided with non-driven rollers which roll against the undersurface of the inner track-lane defining means in a manner to form tipping-preventing means.

When long bridges are to be constructed, it is suitable to use a separate shuttle in addition to a separate crane carriage. In this case, the shuttle is driven backwards and forwards on the bridge, to transport further bridge elements from the bank to the forward end of the bridge. The shuttle comprises a carriage 100 having a chassis 102, wheels 103, a drive motor 104 and hydraulic motors 105. Four lifting units, of which only units 112 and 113 are shown in FIG. 12, are mounted at a respective corner of the carriage chassis 102. The lifting units 112, 113 include hydraulic piston-cylinder devices so arranged as to lift a bridge section at two cross-beams when activated. These two cross-beams will preferably be located equidistant from the centre of a bridge element, so that said element will be balanced when lifted. Subsequent to activating the lifting units and lifting the bridge element 22 to the position illustrated in FIG. 12, the shuttle launches the bridge element and delivers said element immediately behind the crane carriage at the forward end of the bridge. The lifting units 112, 113 return from their extended positions, such as to lower the bridge element onto the forward bridge element 20. The shuttle then returns to the land-end of the bridge, to collect a further bridge element.

The crane carriage now lowers its lifting arm and reverses in beneath the forwardly lifted bridge element until the forward end of the lifting arm has been passed through and beyond this forwardly lifted bridge element. When the lifting arm is completely clear, the arm is lifted vertically upwards and the lifting device 110 is firmly coupled to the third section. The lifting arm is then raised slightly and the crane carriage is driven forward until the bridge section hangs over the foremost end of the foremost bridge section 20, whereupon the lifting arm is lowered and the coupling devices 50, 51, 80 on the male side of the bridge element are coupled with the coupling devices 52–55, 85 on the female side of the stationary bridge element.

When only a short bridge is to be constructed, the shuttle can be dispensed with and the crane carriage provided with four lifting units corresponding to the lifting units 112, 113. The crane carriage will then also have a shuttle function.

As shown in FIG. 12, the crane carriage and the shuttle have seats fitted along both long sides thereof. These seats are intended to seat the bridge fitters or technicians. This enables the fitters to be seated while transported by the crane carriage and/or the shuttle so that they will not constitute an obstacle to or be injured by transported and lifted bridge elements. The seats thus function to protect personnel.

Figure 13:
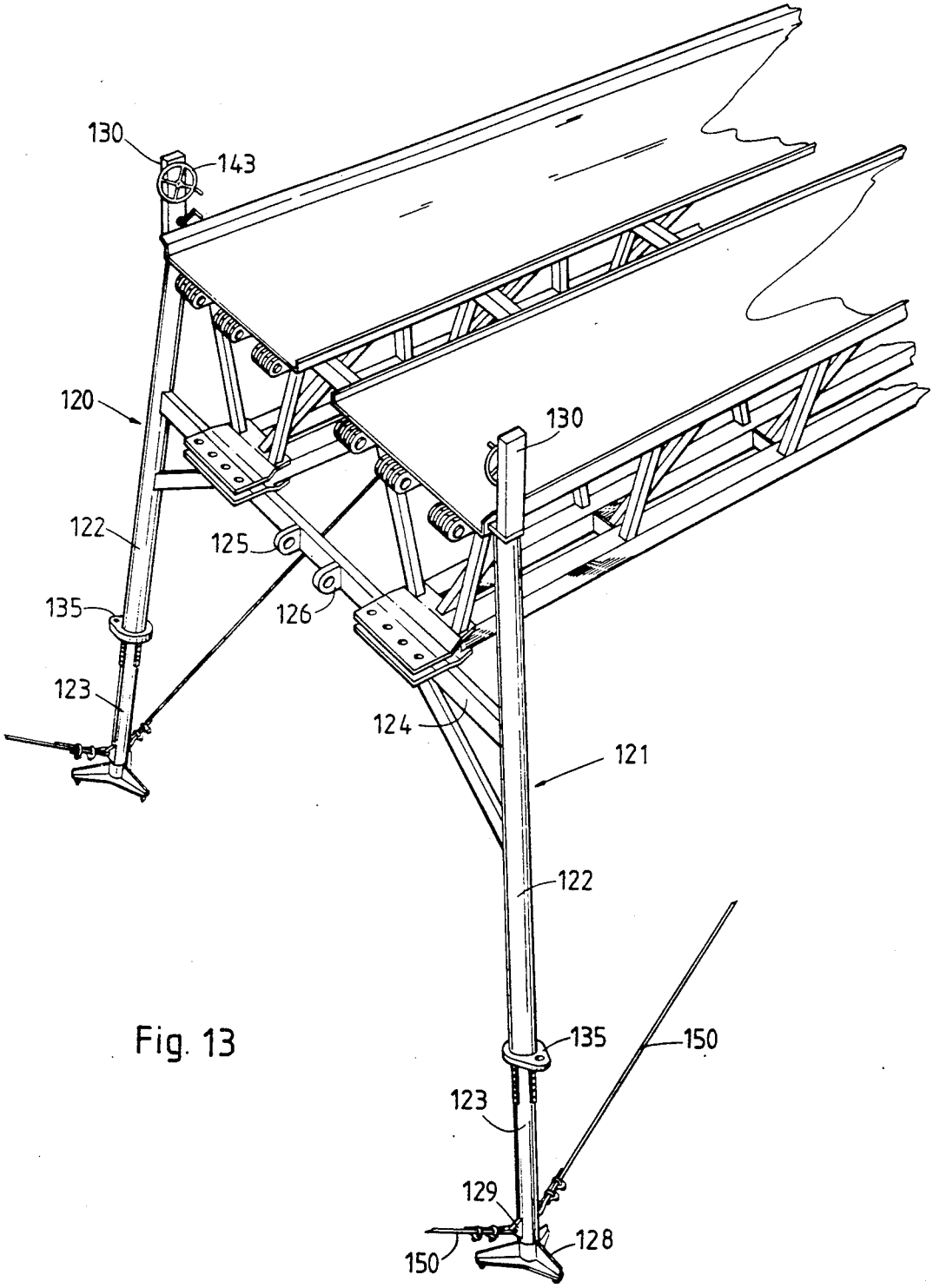
FIG. 13 is a perspective view of a pair of support legs included in the inventive construction kit.
Figure 14:
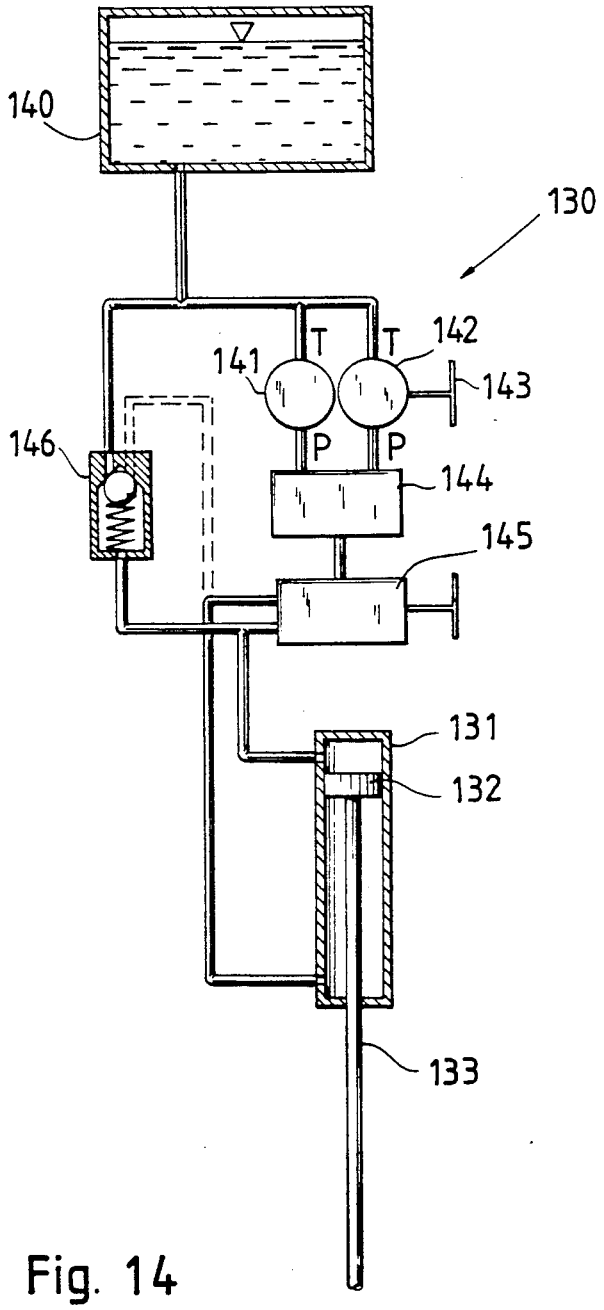
FIG. 14 is a block diagram which illustrates schematically a hydraulic system incorporated in each support leg of the support leg pair shown in FIG. 13.

FIG. 13 is a perspective view of a support-leg pair intended to support a plurality of mutually coupled bridge elements. Each leg pair includes two legs 120 and 121. Each leg consists of an outer cylindrical tube 122 and an inner cylindrical tube 123, which fits telescopically in said outer tube. The legs 120, 121 are mutually connected by means of a cross-beam 124. The bottom beams of the first and second sections of the bridge element rest on this cross-beam 124. The cross-beam 124 is provided with two coupling lugs 125, 126 in which the lifting device 110 engages when lifting a support-leg pair into position. Mounted at the top of each leg 120, 121 is an auxiliary unit 130 which includes a hydraulic system for extending (expanding) and withdrawing (retracting) the inner cylindrical tube 123. As shown in FIG. 14, the hydraulic system includes a hydraulic piston-cylinder device 131 comprising a piston 132 and a piston rod 133. The bottom end of the piston rod 133 can be connected to the inner cylindrical tube 123 by means of a bottom latching device 134, shown in FIG. 15. When the piston rod 133 has been extended from the cylindrical tube 123 to the desired extent as a result of abutment with an abutment plate 160 fixedly mounted within the inner tube, the inner cylindrical tube 123 is fixed to the outer tube 122 by means of an upper latching device 135, shown in FIG. 15. The lower latching device 134 is then released and the hydraulic system activated in order to retract the piston 132 and the piston rod 133, so that the piston rod will not be subjected to corrosion or other damage during the subsequent use of the bridge. When the bridge is later dismantled, the hydraulic system is again activated so as to expand the piston 132 until the forward end of the piston rod comes into engagement with and is connected to the inner tube 123 by means of the lower latching device 134. The upper latching device 135 is then released and the weight of the bridge is taken-up by the hydraulic system. At this stage, the hydraulic system is activated to retract the inner cylindrical tube 123. The piston rod 133 has a working stroke of, e.g., 3 m.

It will be seen from FIG. 14 that each auxiliary unit 130 of the hydraulic system includes an expansion tank 140 for hydraulic fluid, two hydraulic pumps 141, 142, one pump, e.g. pump 141, being intended to roughly position the piston rod 133, and the other pump, e.g. pump 142, being intended to finely adjust the position of the piston rod 133 and therewith also the length of the support leg. To this end, one pump has a large displacement and the other a small displacement. Both pumps 141, 142 are maneuvered by a common motor, to convert mechanical work into hydraulic fluid force. This motor has the form of a hand-operated wheel 143. A setting valve 144, accessible from outside the auxiliary unit 30, is provided for selecting which of the hydraulic pumps 141 or 142 shall be the active unit. The hydraulic system is switched between its expanding or retracting modes by means of a directional valve 145 connected to a pressure-controlled check valve 146. In order to enable a support leg to be expanded rapidly, the centre part of the wheel 143 may be provided with an hexagonal blind hole. The output shaft of a hand-held motor powered by the internal combustion engine 104 on the carriage 100 carries an hexagonal pin which fits into the blind hole. When the hand-held motor is activated, the wheel 143 will be rapidly rotated, and therewith also the hydraulic pump of the hydraulic system.

Figure 16:
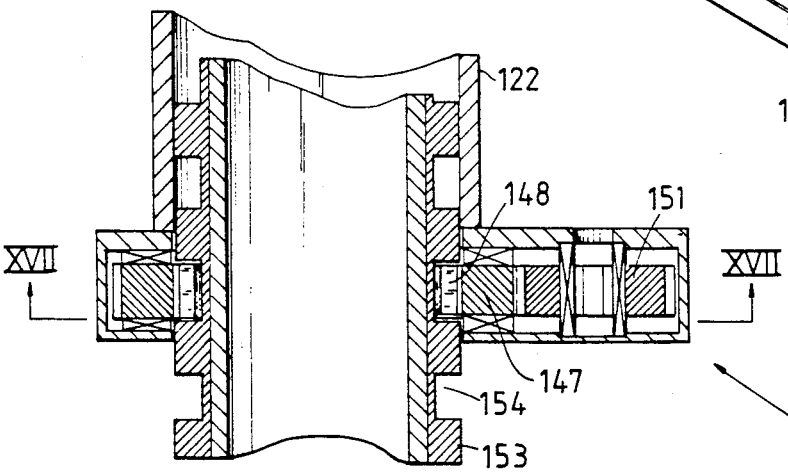
FIG. 16 is an enlarged, cross-sectional view of the upper latching device.
Figure 17:
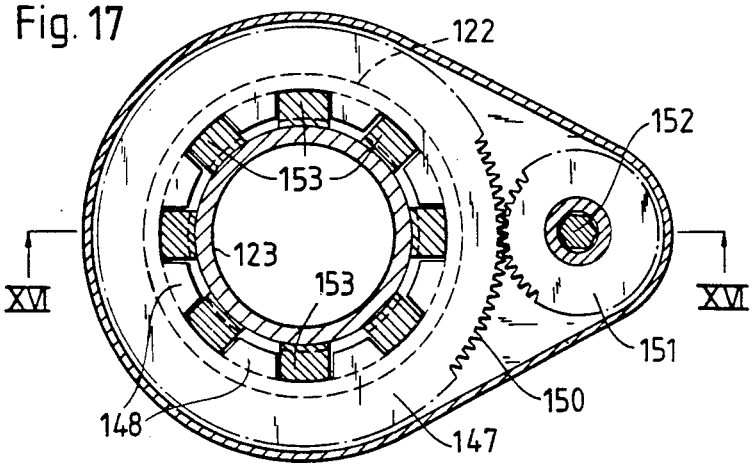
FIG. 17 is a top sectional view of the upper latching device shown in FIG. 16 and is taken on the line XVII—XVII in said Figure.

The upper latching device 135 is described with reference to FIGS. 15, 16 and 17 and includes an annulus 147 which is pivotally mounted on the outer tube 122 and which is provided internally with inwardly directed "teeth" or like projections 148 disposed beneath the lower end of the outer tube 122 and projecting slightly inwardly of the internal wall of the outer tube. It will be seen from FIG. 17 that these teeth or projections 148 are mutually spaced at regular angular distances around the inner wall surface of the annulus. The annulus 147 also has external, radially projecting teeth 150 which mesh with a gearwheel 151 mounted on the end of a shaft 152 which is maneuvered manually from the bridge. Arranged on the outer surface of the inner cylindrical tube 123 is a number of axially extending splines 153 of prismatic cross-section, said splines being mutually spaced at regular angular distances around the circumference of the inner tube. The elongated splines 153 are provided with transversal grooves 154 which are mutually spaced axially at regular intervals. The grooves 154 on a spline are level with corresponding grooves on adjacent splines. Rotation of the shaft 152, and therewith rotation of the annulus 147, will cause the internal teeth 148 on the annulus 147 to be rotated into the grooves of respective splines, therewith to mechanically lock the positions of the outer and inner tubes 122 and 123 respectively in relation to one another.

Figure 15:
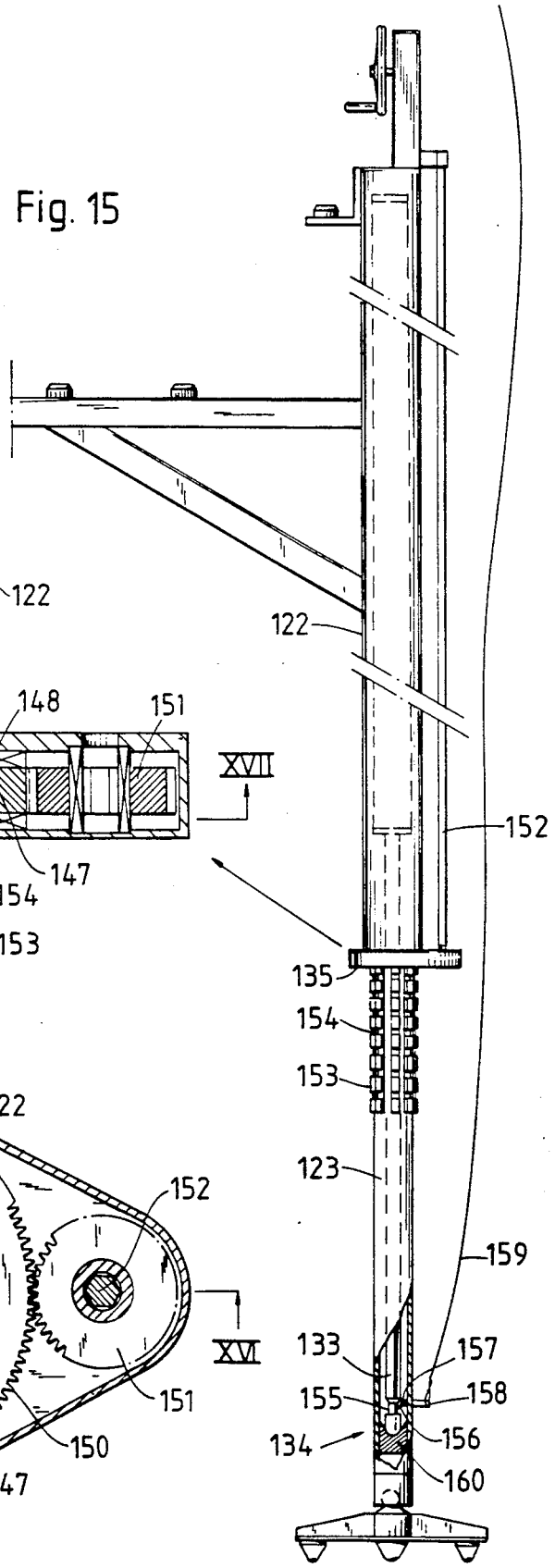
FIG. 15 is a side view, partly in section, of a support leg which is provided with upper and lower latching devices.

When the bridge is to be dismantled and the support legs retracted, the hydraulic system is activated so as to move the piston rod 103 from its retracted position to its expanded position, in which the lower end of the piston rod takes the position illustrated in FIG. 15. It will be seen that the lower end of the piston rod is provided with an annular groove 155 which coacts with a latching pawl 156 mounted on a pivot pin 157 within the inner tube 123. An operating arm 158 extends through the wall of the inner tube 123 and is fixedly attached at one end to the latching pall 156 or may alternatively form an integral part of said pawl. The opposite end of the operating arm has provided therein an opening intended for securing an operating line 159. The piston rod 133 is moved down in the tube 123 until its annular groove 154 comes into engagement with the pawl 156. The hydraulic system is then reversed by resetting the directional valve 145 at the same time as a fitter pulls in the operating line 159, whereupon the point or tip of the latching pawl 156 will come into abutment with the bottom wall surface of the groove 155. Continued movement of the piston rod 133 in an upward direction will result in lifting of the inner cylindrical tube 123 and insertion of said tube into the outer tube 122.

Fitted to the bottom of the inner tube 123 of each support leg 120, 121 (FIG. 13) is a pivotable tripod stand 128 and eyes 129 to which bracing wires 150 can be attached. A bracing wire extends from an attachment eye to a suitable attachment point on the finished bridge.

It will be understood that the aforedescribed embodiment of the invention can be modified and varied in many ways within the scope of the following claims.

I claim:

1. A bridge element comprising a first track lane and a second track lane which are mutually parallel, a framework structure attached to said first track lane and said second track lane, and coupling means for connecting together a plurality of bridge elements sequentially to form a row of bridge elements, said framework structure including a first section which is attached to said first track lane, a second section which extends parallel to the first section and is attached to said second track lane, and a third section which connects the first section and the second section together, the first section and the second section being identical to each other and each including:

(a) a pair of mutually parallel, longitudinally extending bottom beams which are spaced a short distance apart in a first plane;

(b) a triplet of top beams including two outer beams and a central beam, arranged in a second plane located above the first plane, said top beams being mutually parallel and spaced apart at a somewhat larger distance than the bottom beams;

(c) pairs of vertically mounted struts which extend between the pair of bottom beams and the two outer beams of the triplet of top beams, to form a V-shape; and (d) vertical diagonal struts which extend between the pair of bottom beams and connect said pair of bottom beams together and to the central beam of the triplet of top beams;

said third section including a plurality of cross-beams which extend transversely between adjacent outer beams of the first and the second sections to form a longitudinally extending space which is located beneath the tack lanes and which, in section, has the form of an inverse V with a truncated apex.

2. A bridge element according to claim 1 wherein the longitudinally extending space is free of obstacles when seen in a longitudinal extension of the bridge section.

3. A bridge element according to claim 2 wherein the second plane in which the top beams lie is parallel with the first plane in which the bottom beams lie.

4. A bridge element according to claim 3, wherein the bottom beams are angled to form two mutually parallel planes which are located on different levels, and in which the bottom beams are located, and which are parallel with the second plane to form a first ramp section.

5. A bridge element according to claim 3 wherein the second plane is inclined to the first plane to form a second ramp section intended to form a drive-on and drive-off ramp.

6. A bridge element according to claim 1 wherein said coupling means include:

(a) a first array of coupling lugs mounted on end surfaces of the top beams of said triple of top beams which are located at one end of the bridge element, to form a male coupling; and (b) a second array of coupling lugs mounted on end surfaces of the top beams of said triplet of top beams which are located at an opposite end of the bridge element to form a female coupling.

7. A bridge element according to claim 6 wherein each coupling lug includes an end-wall plate which is vertically upstanding from an end surface of each top beam and which is provided with a through-passing first opening.

8. A bridge element according to claim 7 wherein the coupling lugs which form the female coupling are mutually parallel and spaced apart (a) at a distance corresponding to the thickness of a coupling lug which forms the male coupling and (b) at positions at which the coupling lugs which form the female coupling can receive a coupling which forms the male coupling of an adjacent bridge element.

9. A bridge element according to claim 8 wherein the coupling means include a locking rod provided with a plurality of locking pins mounted on a respective dogging element, each dogging element having a first end and a second end, each first end of each dogging element being attached to the locking rod such that each dogging element will extend perpendicularly to said locking rod and such that all dogging elements lie axially in line with one another, the locking pins being anchored to the second end of the dogging elements and having an outer contour which corresponds to a contour of through-passing first openings in the coupling lugs.

10. A bridge element according to claim 9 wherein the lugs of the female coupling comprise a through-passing second opening having a diameter which is slightly larger than the diameter of the locking rod, and a through-passing, elongated third opening which extends between the first openings and the second openings, said third opening having a width which is slightly larger than the thickness of the dogging elements so as to receive said dogging elements when the locking rod is inserted through the coupling lugs of the female coupling.

11. A bridge element according to claim 10 wherein said second array of coupling lugs includes pairs of coupling lugs, one coupling lug of each pair being provided with a guide annulus which is placed around the first opening such as to receive and guide a corresponding locking pin on the locking rod, said guide annulus having an axially extending slot through which the dogging elements can pass and are received.

12. A bridge element according to claim 6 wherein said coupling means further include:

(a) a first coupling tongue mounted on the bottom beams of the first section and the second section and projecting from the bottom beams at an end of the bridge element which includes the male coupling; and (b) two second coupling tongues mounted in spaced relationship above one another on the bottom beams of the first section and the second section and projecting from the bottom beams at an end of the bridge element which includes the female coupling.

13. A bridge element according to claim 12 wherein the first coupling tongues and second coupling tongues are each provided with a respective row of through-passing openings, upper of the second coupling tongues being provided with locking means for moving locking pins between an open position and a locked position so that the locking pins in said open position extend partially through the through-passing openings of an upper coupling tongue of said two second coupling tongues and in the locked position extend through through-passing openings of an upper coupling tongue, and a lower coupling tongue, of said two second coupling tongues.

14. Apparatus for supporting a bridge structure of the type which includes a plurality of bridge elements each comprising two mutually parallel track lanes and coupled together end to end to form a row of bridge elements, comprising:

a pair of support legs extendable from a base to a bridge structure, to support said bridge structure, each leg of said pair of support legs having an outer cylindrical tube having a first end and an opposite second end, and an inner cylindrical tube telescopically slideably mounted within said outer cylindrical tube and having one end and an opposite end, a supporting foot being mounted upon said one end of said inner cylindrical tube;

an auxiliary unit mounted on the first end of the outer cylindrical tube, said auxiliary unit including a hydraulic means comprising a piston, and a piston rod having one end attached to said piston and an opposite end extending towards the second end of the outer cylindrical tube;

bottom latching means mounted on the inner cylindrical tube for releasibly connecting the piston rod relative to the inner tube so that the hydraulic means supports the bridge element when activated in a first direction; and upper latching means mounted on the outer tube for releasibly connecting the outer tube and the inner tube so that the outer tube and the inner tube may be rigidly connected together to support the bridge element.

15. Apparatus according to claim 14 wherein said hydraulic means further includes:

(a) twin hydraulic pumps of which one pump has a displacement which is large relative to the displacement of the other pump, and means for driving said pumps;

(b) a motor switching valve having two inlets, one of which is connected to the one pump and the other of which is connected to the other pump, and an outlet; and (c) a directional valve having an input which is connected to the outlet of the motor switching valve, and which has two outlets, of which one is connected to one end of the hydraulic means for acting on one side of the piston and the other of which is connected to the other end of the hydraulic means for acting on an opposite side of the piston.

16. Apparatus according to claim 15 wherein the bottom latching means includes an abutment plate mounted within the inner cylindrical tube, wherein the opposite end of the piston rod is oriented to abut the abutment plate when the hydraulic means is activated in the first direction, a groove which extends circumferentially around the piston rod at its opposite end, and a latching pawl means which coacts with the groove and which is pivotally mounted within the inner tube for engaging the inner tube through the action of a lever when the piston rod is retracted.

17. Apparatus according to claim 16 wherein the upper latching device includes a plurality of elongated splines which have a prismatic cross-section and which are mounted on an outer wall of the inner tube axially along said inner tube and mutually spaced angularly from one another, said splines being provided with transverse grooves at regular axial intervals from one another, said grooves being level with the groove of adjacent splines, and an annulus which is rotatably mounted around the outer tube and provided with inwardly directed projections which extend through openings in a wall of the outer tube, whereby rotation of the annulus, causes the projections to engage with mutually level transverse grooves on the splines such as to lock the inner and the outer tubes mechanically one to the other.

18. Apparatus according to claim 17 wherein the annulus is provided externally with radially and outwardly projecting teeth; wherein a gearwheel is in mesh with the teeth of said annulus; and wherein a shaft is non-rotatably mounted on the gearwheel to rotate said gearwheel and therewith also rotate the annulus.

19. Apparatus according to claim 18 wherein a cross-beam extends between the pair of support legs and pivotally connects the pair of support legs together.

20. Apparatus according to claim 19 wherein the cross-beam includes two axially spaced lifting shoulders attached thereto.

21. Apparatus according to claim 20 wherein eyes intended for the attachment of bracing lines are mounted on the one end of the inner cylindrical tube.

22. Apparatus according to claim 21 wherein the supporting foot has three legs, said supporting foot being pivotally mounted on said one end of the inner cylindrical tube.

* * * * *